US010455890B2

(12) United States Patent
Huang

(10) Patent No.: US 10,455,890 B2
(45) Date of Patent: Oct. 29, 2019

(54) INTELLIGENT MASSAGE SHOES

(71) Applicant: SHENZHEN FITTOP HEALTH TECHNOLOGY CO., LTD., Shenzhen, Guangdong (CN)

(72) Inventor: Wei Huang, Guangdong (CN)

(73) Assignee: SHENZHEN FITTOP HEALTH TECHNOLOGY CO., LTD., Shenzhen, Guangdong (CN)

( * ) Notice: Subject to any disclaimer, the term of this patent is extended or adjusted under 35 U.S.C. 154(b) by 184 days.

(21) Appl. No.: 15/469,873

(22) Filed: Mar. 27, 2017

(65) Prior Publication Data

US 2017/0196300 A1 Jul. 13, 2017

Related U.S. Application Data

(63) Continuation of application No. PCT/CN2014/090382, filed on Nov. 5, 2014.

(30) Foreign Application Priority Data

Sep. 25, 2014 (CN) ..... 2014 1 0495518

(51) Int. Cl.
*A43B 7/00* (2006.01)
*A61H 23/00* (2006.01)
(Continued)

(52) U.S. Cl.
CPC ..... *A43B 7/00* (2013.01); *A43B 3/0005* (2013.01); *A43B 7/146* (2013.01); *A61H 23/006* (2013.01);
(Continued)

(58) Field of Classification Search
CPC ..... A43B 7/00; A43B 3/0005; A43B 7/146; A61H 23/006; A61H 39/00
(Continued)

(56) References Cited

U.S. PATENT DOCUMENTS 4,694,831 A * 9/1987 Seltzer ..... A43B 7/00 15/227
4,802,463 A * 2/1989 Rojas ..... A61H 23/0263 36/1
(Continued)

FOREIGN PATENT DOCUMENTS

CN 2668111 Y 1/2005
CN 202027481 U 11/2011
(Continued)

OTHER PUBLICATIONS

WO2009152544A1—ESPACENET German to English translation.*
(Continued)

*Primary Examiner* — Alissa J Tompkins
*Assistant Examiner* — Catherine M Ferreira
(74) *Attorney, Agent, or Firm* — Locke Lord LLP; Tim Tingkang Xia, Esq.

(57) ABSTRACT

The invention discloses a pair of intelligent massage shoes, each including a vamp, a sole composed of a sole plate and a cushion plate, and massage columns arranged in the sole plate and stretching out of the cushion plate. The massage columns are matched with positions of acupuncture points of a sole, and are driven to carry out a reciprocating motion up and down through a lifting power device, thus massaging the sole. The lifting power device is fixed on a bottom plate, which is connected with an adjustment power device that pushes the lifting power device to move back and forth, thus adjusting the front and back positions of the massage columns to adapt to feet with different sizes. Each shoe has an air pocket charged with air through an electric air charging apparatus, thus forming a space in the shoe adaptive to accommodate the feet with different sizes.

8 Claims, 7 Drawing Sheets

(51) Int. Cl.

| | |
|---|---|
| ***A61H 39/04*** | (2006.01) |
| ***A43B 3/00*** | (2006.01) |
| ***A43B 7/14*** | (2006.01) |
| ***A61H 39/00*** | (2006.01) |

(52) U.S. Cl.
CPC ..... *A61H 39/00* (2013.01); *A61H 39/04* (2013.01); *A61H 2201/0103* (2013.01); *A61H 2201/0192* (2013.01); *A61H 2201/123* (2013.01); *A61H 2201/1284* (2013.01); *A61H 2201/164* (2013.01); *A61H 2201/165* (2013.01); *A61H 2201/1654* (2013.01); *A61H 2201/50* (2013.01); *A61H 2201/5097* (2013.01); *A61H 2205/12* (2013.01)

(58) Field of Classification Search
USPC ..... 36/140, 141
See application file for complete search history.

(56) References Cited

U.S. PATENT DOCUMENTS 4,936,292 A * 6/1990 Hidetsugu ..... A61H 39/04 601/104
5,235,761 A * 8/1993 Chang ..... A43B 1/0072 36/137
5,681,266 A * 10/1997 Lin ..... A61H 23/006 601/101
5,682,690 A * 11/1997 Chang ..... A43B 7/00 36/11.5
6,285,144 B1 * 9/2001 Shih ..... A61H 1/0237 318/15
6,632,187 B2 * 10/2003 Bak ..... A61H 7/001 601/134
7,614,168 B1 * 11/2009 Zummer ..... A61H 15/0078 36/141
2008/0010868 A1 1/2008 Tsai
2008/0120774 A1 * 5/2008 Hite ..... A41B 13/06 5/494

FOREIGN PATENT DOCUMENTS

CN 202095630 U 1/2012
CN 204120337 U 1/2015
JP 2002325819 A 11/2002
WO WO 2009152544 A1 * 12/2009 ..... A61H 23/0254

OTHER PUBLICATIONS

State Intellectual Property Office of the P. R. C, "Office Action", dated Sep. 1, 2015, China.
State Intellectual Property Office of the P. R. C, "Notice of Allowance", dated Feb. 1, 2016, China.
State Intellectual Property Office of the P.R. China (ISR/CN), "International Search Report for PCT/CN2014/090382", China, dated Jun. 4, 2015.

* cited by examiner

INTELLIGENT MASSAGE SHOES

CROSS REFERENCE TO RELATED APPLICATIONS

The present application is a continuation of international application no. PCT/CN2014/090382, filed on Nov. 5, 2014, which claims priority to China Patent Application no. 201410495518.7, filed on Sep. 25, 2014, both of which are hereby incorporated by reference in their entireties.

TECHNICAL FIELD

The present invention relates to a pair of intelligent massage shoes.

BACKGROUND ART

Massage shoes are becoming more and more popular among ordinary consumers owing to their health care efficacies. There are two main forms of massage shoes on the market: 1, ordinary massage shoes in which massage columns are fixedly arranged on insoles and matched with the positions of acupuncture points of soles, such that insteps contact the massage columns by means of pressure generated when a user walks to press the acupuncture points of soles, and for such massage manner of pressing by means of the human body gravity, the massage forces cannot be adjusted effectively, and the user easily feels aching because all the acupuncture points are pressed simultaneously in a walking process; 2, electric massage shoes in which electrodes are generally arranged on massage columns to generate low-frequency pulses and produce a health care effect, but a circuit control portion for electromagnetic pulses is very complicated, and the user generally fails to select an appropriate frequency-band correctly to affect on usability. In addition, for massage shoes in the prior art, front and back positions of massage columns cannot be adjusted, and demands of consumers having different shoe sizes cannot be satisfied.

Therefore, it is an urgent technical problem to solve about how to design a pair of intelligent massage shoes which can adapt to massage demands of different shoe sizes and have a good massage effect and in which massage columns move up and down orderly for massage.

SUMMARY OF THE INVENTION

To solve the said technical problem, the present invention provides a pair of intelligent massage shoes which can adapt to massage demands of different shoe sizes and have a good massage effect and in which massage columns move up and down orderly for massage.

The technical solution adopted by the present invention is as follows: a pair of intelligent massage shoes is designed, each of which comprising: a vamp, a sole composed of a sole plate and a cushion plate, and massage columns arranged in the sole plate and stretching out of the cushion plate, wherein the massage columns are matched with the positions of acupuncture points of a sole, and a lifting power device which can push the massage columns to move up and down is arranged in the sole, the lifting power device comprising: at least one guide pillar longitudinally arranged in the sole plate, a lifting motor arranged at one end of the guide pillar and connected with the guide pillar in a transmission manner, cams fixed on the guide pillars respectively and matched with the massage columns in positions, and circular rings rotatably arranged on the outer circles of the cams, wherein the top of each circular ring is fixedly connected with the corresponding massage column, and the cams on the guide pillars, that are adjacent front and back, are fixed at an inclination angle of 90° ; the lifting motor drives each guide pillar to rotate, and the cams push the massage columns to carry out a reciprocating motion up and down through the circular rings.

An adjusting power device for adjusting the front and back positions of the massage columns is also arranged in the sole, the adjusting power device comprising a pushing and pulling motor arranged in the sole plate, a bottom plate fixedly connected with the lifting power device, a sliding rail assembly arranged between the bottom surface of the bottom plate and the internal bottom surface of the sole, and a connecting rod member arranged between an output shaft of the pushing and pulling motor and the bottom plate; the cushion plate is provided with strip openings matched with front and back movements of the massage columns; the pushing and pulling motor drives the connecting rod member to pull the bottom plate, and the bottom plate drives the whole lifting power device to move back and forth along the sliding rail assembly.

An air pocket which is matched with a shoe type is arranged between the vamp and the cushion plate, an electric air charging apparatus matched with the air pocket is arranged in the sole plate and is connected with the air pocket through an air pipe, and an exhaust valve connected with the electric air charging apparatus is also arranged on the outside surface of the sole plate.

An electrical assembly which is connected with the lifting power device, the adjusting power device and the electric air charging apparatus respectively is also arranged in the sole plate, the electrical assembly comprising: a PCB assembly arranged in the sole plate, a battery connected with the PCB assembly, and a key and a charging socket which are arranged on the outside surface of the sole plate and connected with the PCB assembly.

In one embodiment, each intelligent massage shoe further comprises a remote controller arranged outside the massage shoes, a wireless receiving module arranged in the PCB assembly, a wireless transmitting module which is matched with the wireless receiving device and is arranged in the remote controller, and a remote control key which is connected with the wireless transmitting module and arranged on the remote controller.

A positioning pin is transversely arranged at a position, where the cam is located, on each guide pillar, a side surface of the cam is provided with a positioning groove matched with the positioning pin, and the other side surface of the cam is provided with a retainer ring; a concave ring matched with the retainer ring is arranged on the guide pillar, and the cam is positioned on the guide pillar under the matching of the positioning groove and the positioning pin, and the front and back positions of the cam are locked by the retainer ring.

The lifting motor is driven by a gear set, an output shaft of the lifting motor is connected with a driving gear, each guide pillar is provided with a driven gear, the driven gears of adjacent guide pillars are engaged, the driven gear of one guide pillar is engaged with the driving gear; the lifting motor is fixed on the bottom surface of the bottom plate.

Fixing seats for rotatably fixing two ends of each guide pillar are arranged on the bottom plate, two ends of the guide pillar are sleeved with a bearing respectively, each fixing seat is formed by fixedly connecting an upper part and a lower part and is internally provided with a bearing groove matched with the bearing, and the bearing is mounted in the bearing groove; a positioning seat for fixing each circular ring in a liftable manner is also arranged on the bottom plate, a cylinder stretching out horizontally is arranged on the upper end and the lower end of one side surface of each circular ring respectively, the outer end of the cylinder is movably sleeved with a roller, and a position where the positioning seat is arranged is matched with the circular ring; each positioning seat is formed by fixedly connecting an upper part and a lower part, a circular groove matched with the guide pillar is formed in the middle of the positioning seat, a side surface, adjacent to the cylinder, of the positioning seat is provided with an upright sliding chute which has an appropriate size for allowing the roller to slide up and down therein, the outside surface of the upright sliding chute is provided with an upright notch matched with the diameter of the cylinder, and the roller is arranged in the upright sliding chute.

The sliding rail assembly comprises: sliding rods fixed below two sides of the bottom plate, and at least two sliding rail seats the top ends of which are fixed to the bottom surfaces of two sides of the bottom plate, the bottom end of each sliding rail seat is provided with holes matched with the sliding rods, a wall of each hole is provided with grooves that are recessed inwards at intervals, and each siding rod is sleeved with the bottom end of the sliding rail seat through the holes.

11 massage columns are arranged in each sole plate, three guide pillars are arranged in the lifting power device, and the massage columns are connected to the three guide pillars respectively according to the positional arrangement thereof.

Compared with the prior art, the lifting power device is fixedly connected to the massage columns of the present invention and drives the massage columns to carry out a reciprocating motion up and down, thereby massaging the soles. Particularly preferably, the lifting power device is fixed on a bottom plate, the bottom plate is connected with the adjustment power device, and the whole lifting power device is pushed to move back and forth by the adjusting power device, thus adjusting the front and back positions of the massage columns to adapt to feet with different sizes to massage. Further, an air pocket is arranged in each intelligent massage shoe, the air pocket is charged with air through the electric air charging apparatus, thus a space in the shoe is adaptive to accommodate the feet with different sizes, and moreover, the pressures of soles placed on the massage columns can also be adjusted through adjusting the tightness of the air pocket, thus adjusting the massage forces felt by the soles.

BRIEF DESCRIPTION OF THE DRAWINGS

The present invention will be described in detail as below in conjunction with embodiments and drawings, wherein.

DETAILED DESCRIPTION OF THE PREFERRED EMBODIMENTS

Figure 1:
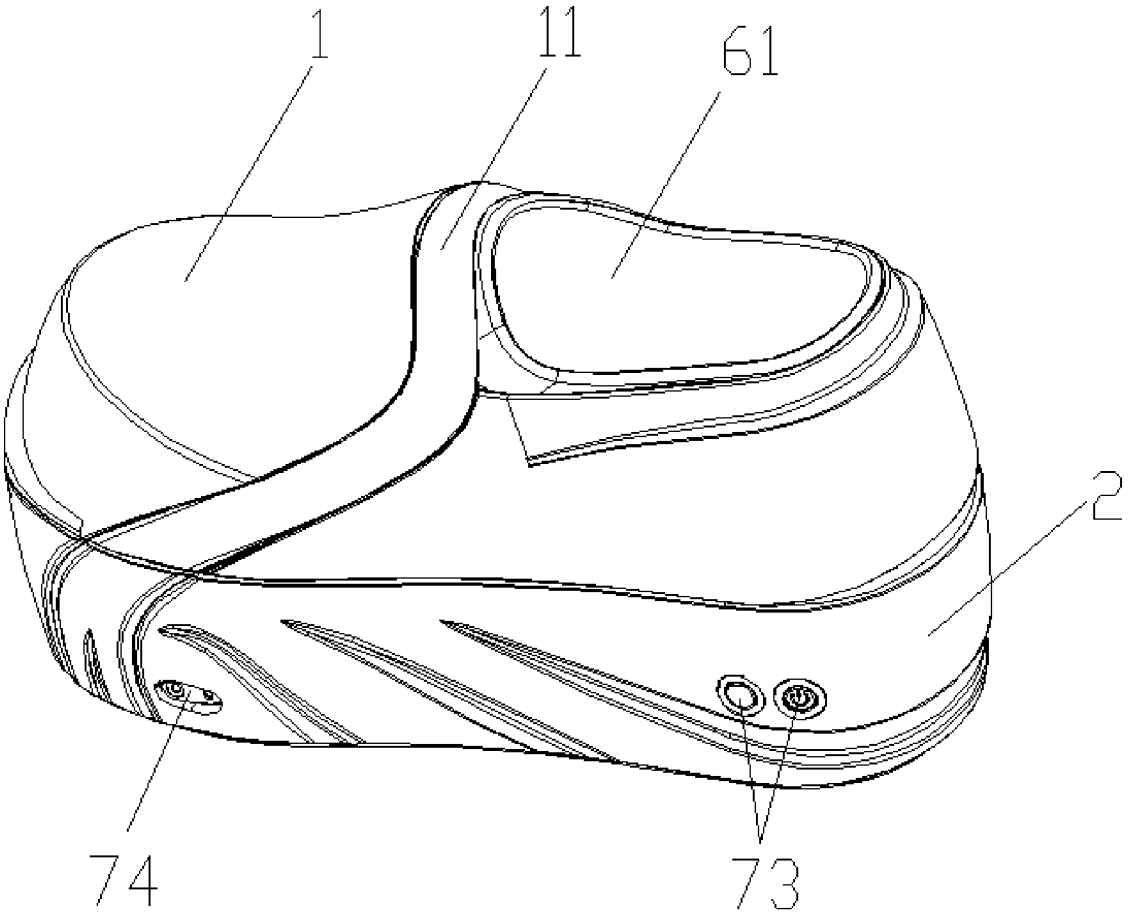
FIG. 1 is an appearance schematic drawing of the present invention.
Figure 2:
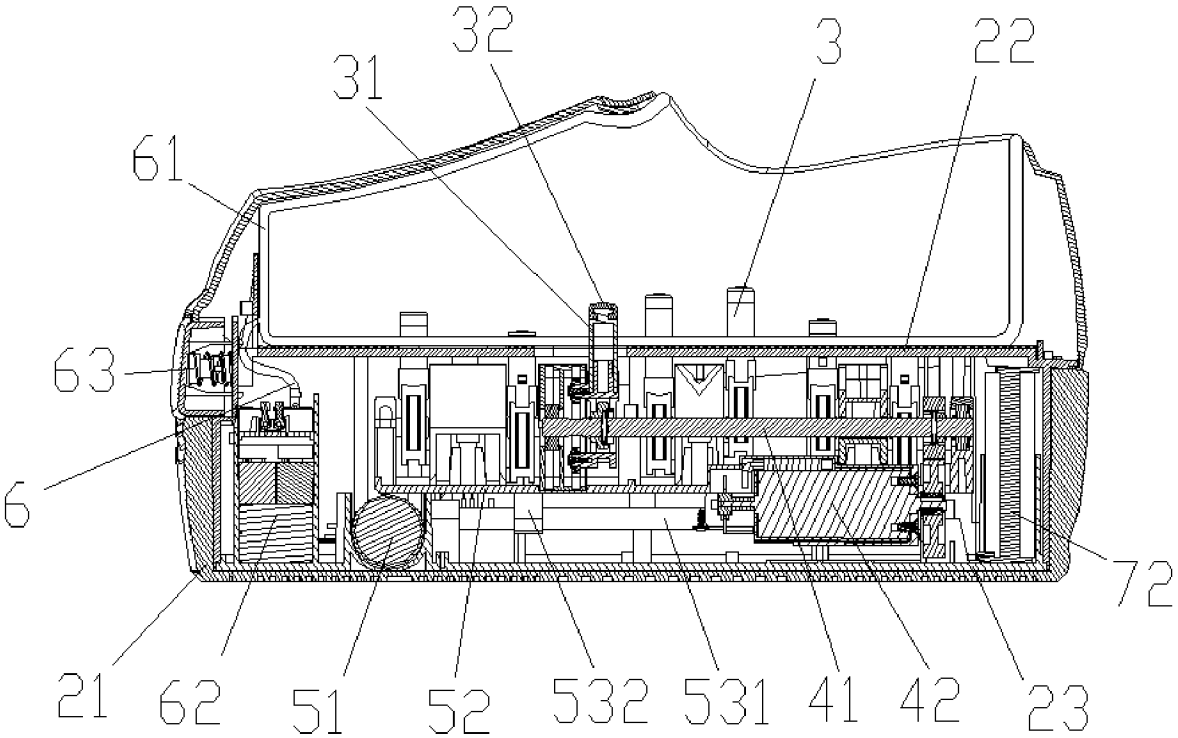
FIG. 2 is a vertical section schematic drawing of the present invention.
Figure 3:
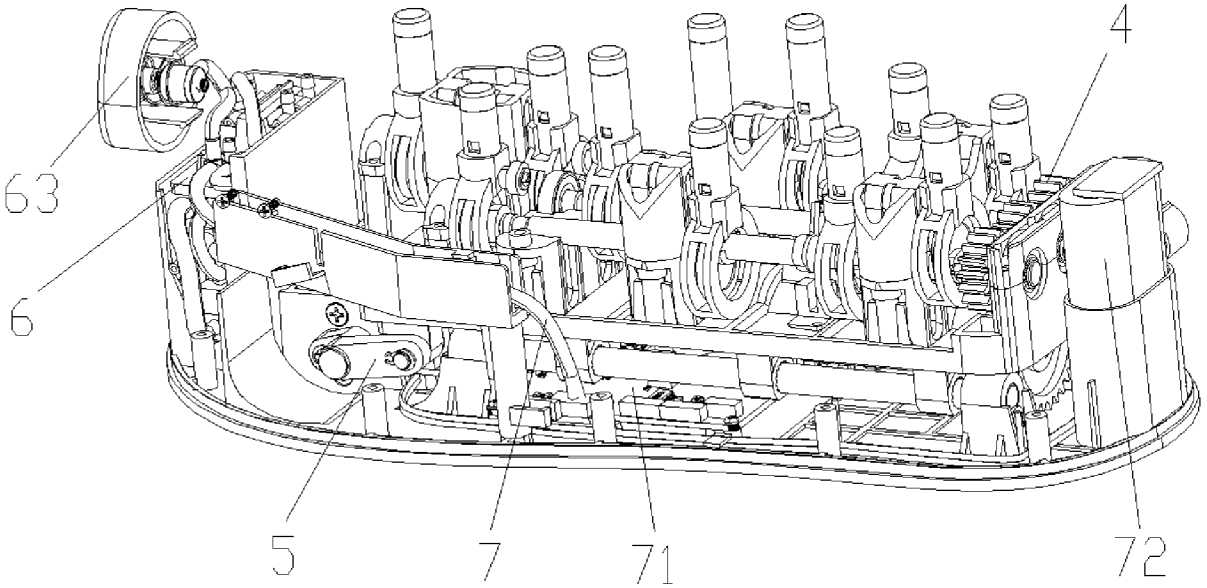
FIG. 3 is a connecting schematic drawing of a structure in a sole of the present invention.

As shown in FIGS. 1-3, the present invention provides a pair of intelligent massage shoes. Each intelligent massage shoe comprises a vamp 1, a sole 2 composed of a sole plate 21 and a cushion plate 22, and massage columns 3 arranged in the sole plate and stretching out of the cushion plate, wherein the massage columns 3 are matched with the positions of the acupuncture points of a sole, and a lifting power device 4, an adjustment power device 5 and an air charging device 6 are arranged in the sole 2.

Figure 4:
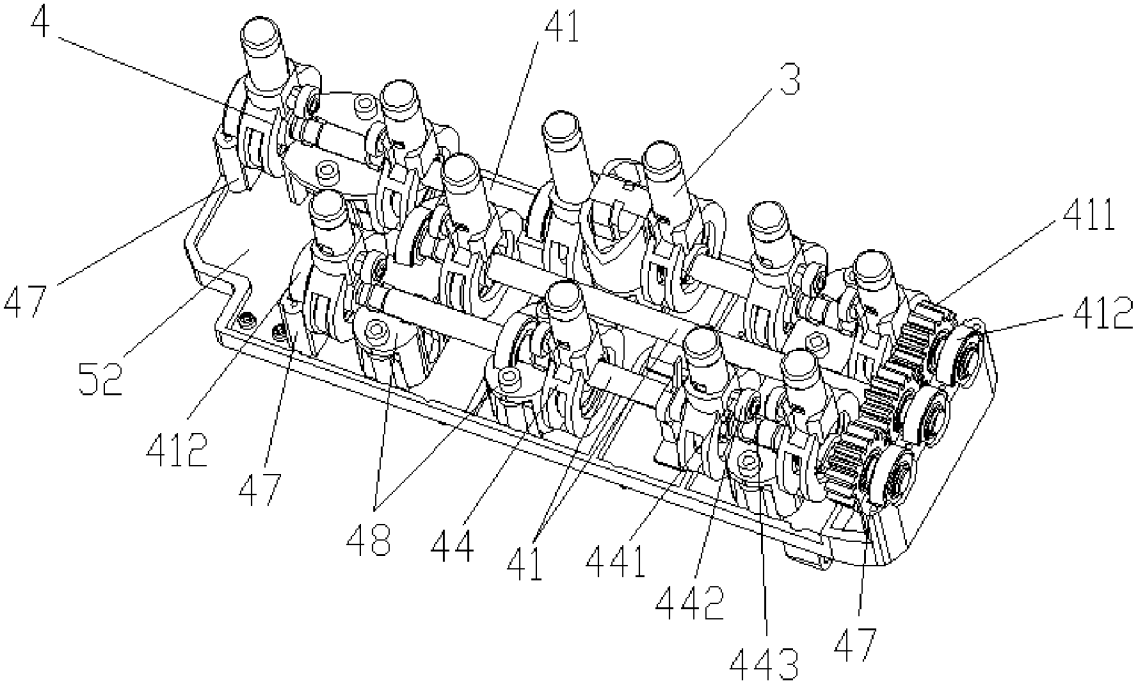
FIG. 4 is a structural schematic drawing of the lifting power device of the present invention.

As shown in FIG. 4, the lifting power device 4 comprises: at least one guide pillar 41 longitudinally arranged in the sole plate 21, a lifting motor 42 arranged at one end of the guide pillar 41 and connected with the guide pillar 41 in a transmission manner, cams 43 fixed on the guide pillars 41 respectively and matched with the massage columns 3 in positions, and circular rings 44 rotatably arranged on the outer circles of the cams 43, wherein the top of each circular ring 44 is fixedly connected with the corresponding massage column 3, the lifting motor 42 drives each guide pillar 41 to rotate, and the cams 43 push the massage columns 3 to carry out a reciprocating motion up and down through the circular rings 44. The cams 43 on the guide pillars 41, that are adjacent front and back, are fixed at an inclination angle of 90ing power devicelumn intelligent massage shoe comprises a vamp 41 deflect toward the same direction, setting of the inclination angles of the cams 43 can ensure ordered lifting of the massage columns 3, and the massage columns 3 contact the sole at intervals, such that the massage effect and the massage comfort level are improved.

Figure 5:
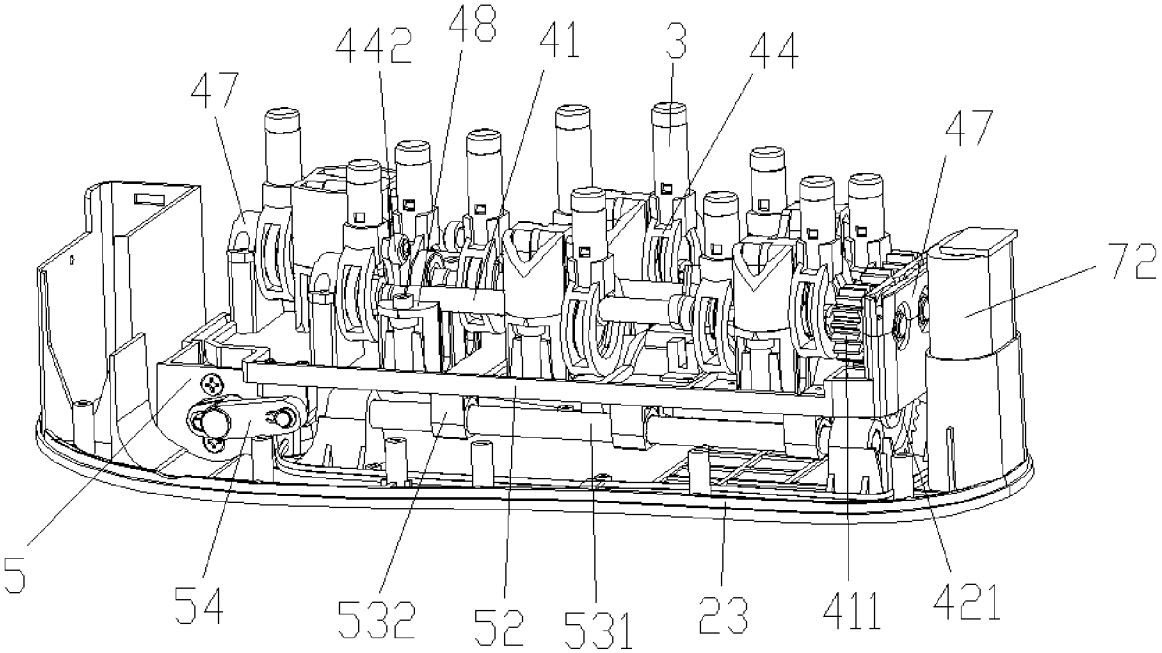
FIG. 5 is a structural schematic drawing of the adjusting power device of the present invention.

As shown in FIG. 5, the adjusting power device 5 comprises: a pushing and pulling motor 51 arranged in the sole plate 21, a bottom plate 52 fixedly connected with the lifting power device 4, a sliding rail assembly 53 arranged between the bottom surface of the bottom plate 52 and the internal bottom surface of the sole, and a connecting rod member 54 arranged between an output shaft of the pushing and pulling motor 51 and the bottom plate 52; the cushion plate 22 is provided with strip openings matched with front and back movements of the massage columns 3; the pushing and pulling motor 51 drives the connecting rod member 54 to pull the bottom plate 52, and the bottom plate 52 drives the whole lifting power device 4 to move back and forth along the sliding rail assembly 53, thereby adjusting the front and back positions of the massage columns 3 to adapt to feet with different sizes to massage; the pushing and pulling motor 51 is arranged at a toe cap to reduce the width of the shoe body.

As shown in FIG. 2, the air charging device 6 comprises: an air pocket 61 arranged between the vamp 1 and the cushion plate 22 to adapt to the shoe type, and an electric air charging apparatus 62 arranged in the sole plate 21 and matched with the air pocket 61, wherein the electric air charging apparatus 62 is matched with the air pocket 61 through an air pipe, and an exhaust valve 63 connected with the electric air charging apparatus 62 is also arranged on the outside surface of the sole plate 21. The electric charging apparatus 62 is arranged at the toe cap to reduce the width of the shoe body, and the exhaust valve 63 is arranged outside the shoe cap in cooperation with the electric charging apparatus 62. The air pocket 61 is charged with air through the electric air charging apparatus 62, thus a space in the shoe is adaptive to accommodate the feet with different sizes, and moreover, the pressures of soles placed on the massage columns 3 can also be adjusted through adjusting the tightness of the air pocket 61, thus adjusting the massage forces felt by the soles.

As shown in FIG. 3, an electrical assembly 7 which is connected with the lifting motor 42, the pushing and pulling motor 51 and the electric air charging apparatus 61 respectively is also arranged in the sole plate 21, the electrical assembly 7 comprising: a PCB assembly 71 arranged in the sole plate 21, a battery 72 connected with the PCB assembly, and a key 73 and a charging socket 74 which are arranged on the outside surface of the sole plate 21 and connected with the PCB assembly 71. In one embodiment, each intelligent massage shoe further comprises: a remote controller arranged outside the massage shoe, a wireless receiving module arranged in the PCB assembly 71, a wireless transmitting module which is matched with the wireless receiving device and arranged in the remote controller, and a remote control key which is connected with the wireless transmitting module and arranged on the remote controller. The state of the massage shoes can be controlled and adjusted by the remote controller when the massage shoes are used. In actual application, a circle of middle shell 23 which is attached to the inner wall of the sole plate is arranged inside the sole of the massage shoe, the lifting power device, the adjusting power device and the electric air charging apparatus are all arranged on the middle shell 23, a surrounding edge of which the bottom end is connected with the middle shell 23 is arranged on the edge of the cushion plate 22 vertically downwards, the surrounding edge of the cushion plate 22 and the middle shell can reinforce the structure to prevent damage or electric leakage, and the vamp 1 is further provided with a circle of metal ornaments 11, such that the appearance of the massage shoes is attractive.

Figure 6C:
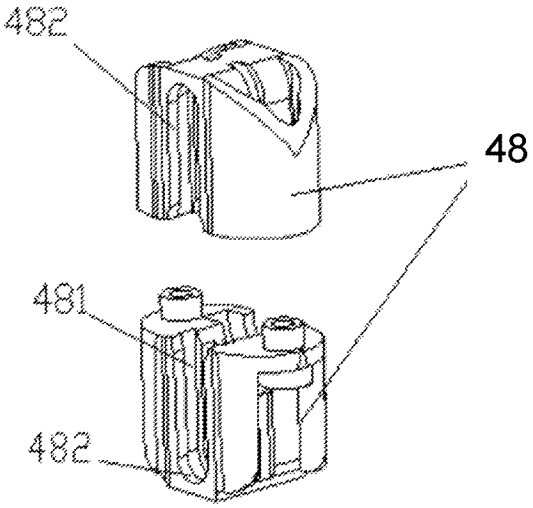
FIG. 6C is a perspective view of the positioning seats of the present invention.
Figure 6B:
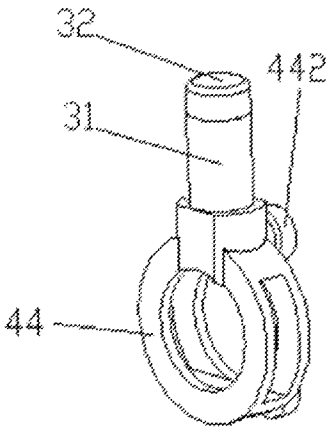
FIG. 6B is a perspective view of a circular ring of the present invention.
Figure 6A:
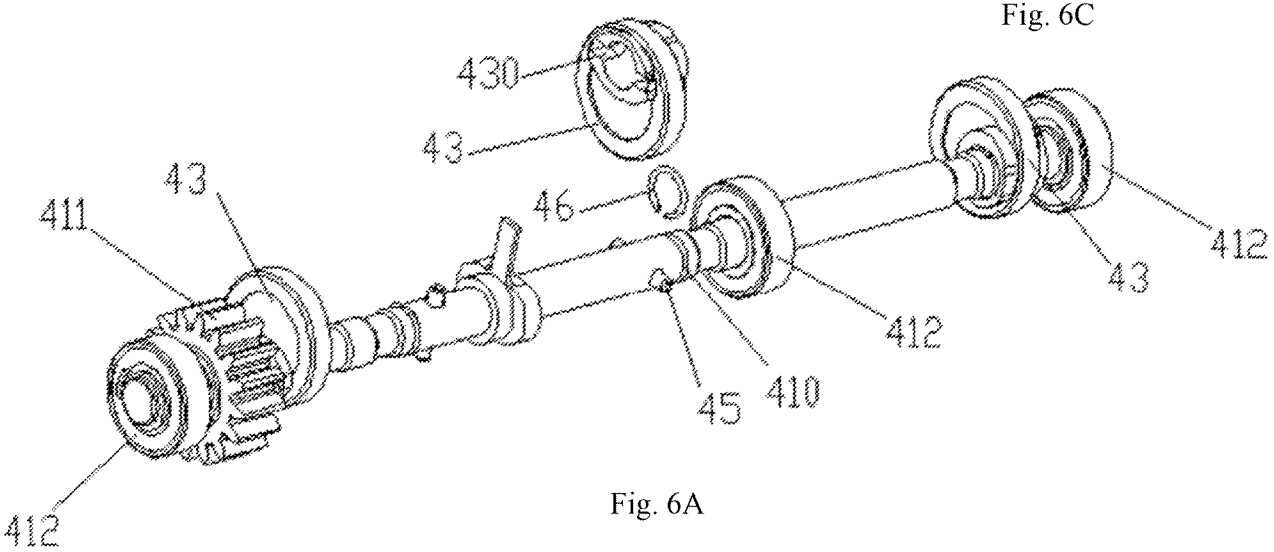
FIG. 6A is a partially exploded drawing of a positioning structure of the cam and the guide pillar of the present invention.

In this embodiment, 11 massage columns 3 are arranged in the sole plate 21, wherein each massage column 3 is composed of a support column 31 and a massage head 32 arranged on the top end of the support column, and the top surface of each massage head 32 is a smooth circular arc surface; three guide pillars 41 are arranged in the lifting power device 4, and the massage columns 3 are connected to the three guide pillars 41 according to the positional arrangement thereof. As shown in FIGS. 6A, 6B and 6C, a positioning structure of the cam and the guide pillar is as follows: a positioning pin 45 is transversely arranged at a position, where the cam 43 is located, on the guide pillar 41, a side surface of the cam 43 is provided with a positioning groove 430 matched with the positioning pin 45, and the other side surface of the cam 43 is provided with a retainer ring 46, a concave ring 410 matched with the retainer ring 46 is arranged on the guide pillar 41, and the cam 43 is positioned on the guide pillar 41 under the matching of the positioning groove 430 and the positioning pin 45, and the front and back positions of the cam 43 are locked by the retainer ring 46. During mounting, the positioning pin 45 is aligned and inserted to the positioning groove 430 of the cam 43, and then the retainer ring 46 is mounted on the other side surface of the cam 43, such that the cam 43 and the guide pillar 41 can be fixed.

As shown in FIG. 4 and FIG. 5, the lifting motor 42 is driven by a gear set, an output shaft of the lifting motor 42 is connected with a driving gear 421, each guide pillar 41 is provided with a driven gear 411, the driven gears 411 of adjacent guide pillars 41 are engaged, and the driven gear of one guide pillar is engaged with the driving gear; the lifting motor 42 is fixed on the bottom surface of the bottom plate 52. In this embodiment, a driven gear 411 of the middle guide pillar among the three guide pillars 41 is engaged with a driving gear 421 and is delivered to the driven gears 411 at two sides respectively to ensure a balance of transmission forces among the gears.

Figure 7B:
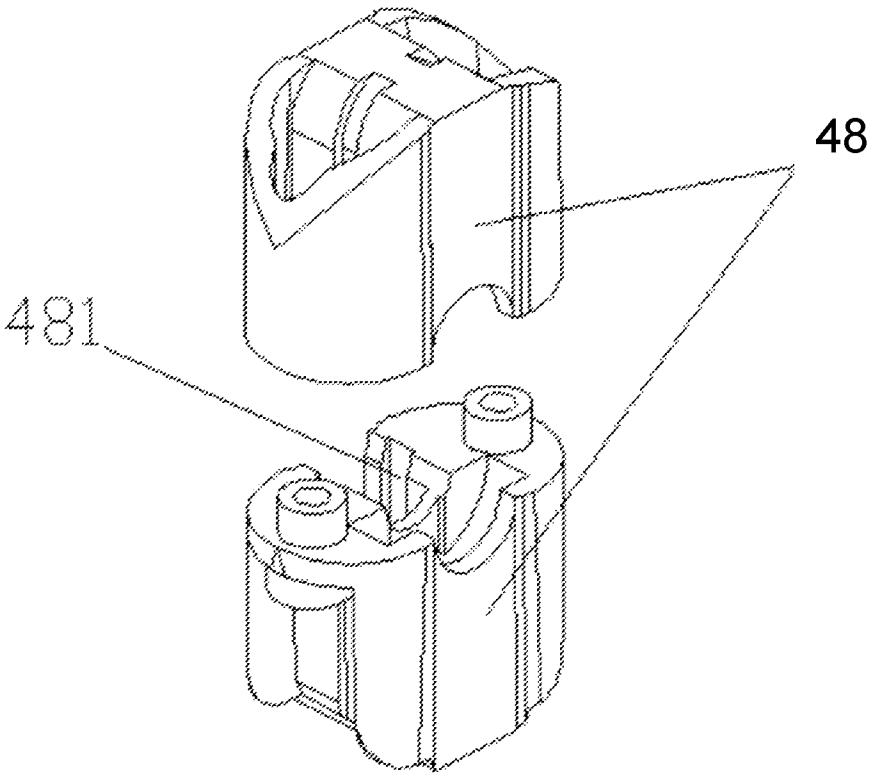
FIG. 7B is a perspective view of the positioning seats of the present invention from another viewing angle.
Figure 7A:
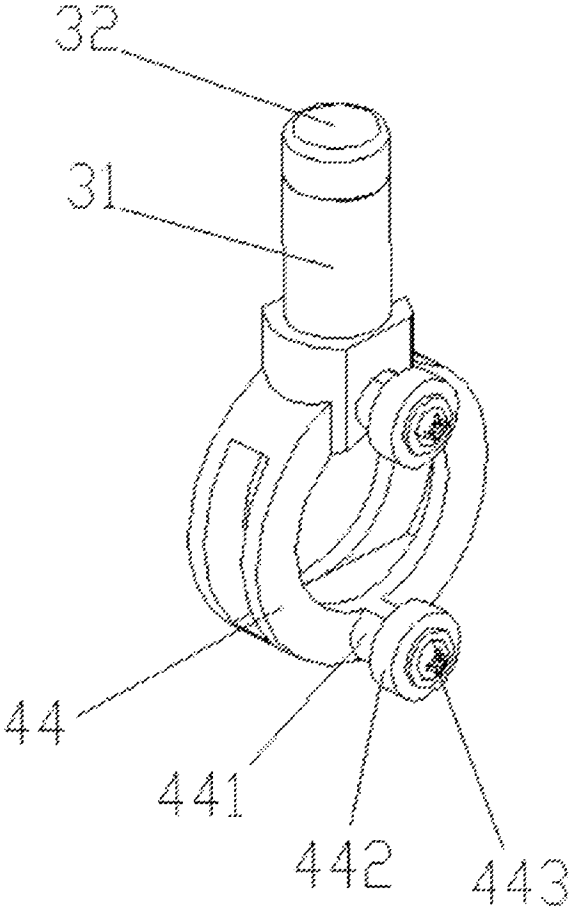
FIG. 7A is a perspective view of the circular ring of the present invention.

Fixing seats 47 for rotatably fixing two ends of each guide pillar 41 are arranged on the bottom plate 52, two ends of the guide pillar 41 are sleeved with a bearing 412 respectively, each fixing seat 47 is formed by fixedly connecting an upper part and a lower part and is internally provided with a bearing groove matched with the bearing 412, and the bearing 412 is mounted in the bearing groove. As shown in FIGS. 7A and 7B, a cylinder 441 stretching out horizontally is arranged at the upper end and the lower end of each circular ring 44 respectively, wherein the diameter of the outer end of the cylinder 441 is smaller than that of the inner end, the outer end of the cylinder 441 is movably sleeved with a roller 442, the outer diameter of the roller 442 is larger than that of the inner end of the cylinder, and the outer end of the cylinder 441 limits front and back movements of the roller 442 on the cylinder through a locking screw 443. A positioning seat for fixing each circular ring 44 in a liftable manner is also arranged on the bottom plate 52, and a position where the positioning seat 48 is arranged is matched with the circular ring 44; each positioning seat 48 is formed by fixedly connecting an upper part and a lower part, a circular groove matched with the guide pillar 41 is formed in the middle of each positioning seat 48, a side surface, adjacent to the cylinder 441, of the positioning seat 48 is provided with an upright sliding chute 481 which has an appropriate size for allowing the roller 442 to slide up and down therein, the outside surface of the upright sliding chute 481 is provided with an upright notch 482 matched with the diameter of the inner end of the cylinder 441, and the roller 442 is arranged in the upright sliding chute 481. In actual application, in order to satisfy the demands of positional distances of the massage columns 3 for specific acupuncture points, the circular rings 44 can be arranged at both sides of each positioning seat 48 in a matching manner, and an upright sliding chute 481 and an upright notch 482 are formed in each of the upper side and the lower side of the positioning seat 48; when the circular ring is arranged only at one side of the positioning seat 48 in a matching manner, one side, matched with the circular ring, of the positioning seat 48 is provided with an upright sliding chute 481 and an upright notch 482, and the other side of the positioning seat 48 is provided with a bearing groove matched with a bearing 412, and a position, matched with the bearing groove, on each guide pillar is sleeved with a bearing 412 to ensure smooth rotation of the guide pillar.

The upper parts and the lower parts of each fixing seat 47 and each positioning seat 48 are fixedly connected respectively through screws. During mounting, as shown in FIG. 4, the upper parts of the fixing seat 47 and the positioning seat 48 are taken down, the cams 43 and the circular rings 44 are mounted on the guide pillars 41, then the bearings 412 are fixed at two ends of each guide pillar 41, the bearings 412 at two ends of the guide pillar 41 are put into the bearing groove in the lower part of the fixing seat 47, at this moment, the guide pillars 41 are just located inside the circular groove in the lower part of the positioning seat 48, and the roller 442 at the lower end of each circular ring 44 is positioned inside the upright sliding chute 481 in the lower part of the positioning seat. As shown in FIG. 5, the upper part of the fixing seat 47 is covered and tightly locked, the guide pillars 41 can be rotatably fixed on the fixing seat 47, the upper part of the positioning seat 48 is covered and tightly locked, and the roller 442 at the upper end of each circular ring 44 is inserted into the upright sliding chute 481 in the upper part of the positioning seat, such that the circular ring 44 can be fixed on the seating seat 48 in a liftable manner. Of course, for smooth rotation of each guide pillar 41, a bearing 412 may also be arranged between the circular groove of the positioning seat 48 and the guide pillar 41.

As shown in FIG. 5, the sliding rail assembly 53 of the adjusting power device comprises: sliding rods 531 fixed below two sides of the bottom plate 52, and at least two sliding rail seats 532 the top ends of which are fixed to the bottom surfaces of two sides of the bottom plate 52, wherein the bottom end of each sliding rail seat 532 is provided with holes matched with the sliding rods 531, a wall of each hole is provided with grooves that are recessed inwards at intervals, and the siding rod 531 is sleeved with the bottom end of the sliding rail seat 532 through the holes. The contact area between the holes and the sliding rods is reduced due to setting of the grooves, so as to reduce the friction force and enables more smooth pushing and pulling.

The above mentioned are merely preferred embodiments of the present invention, rather than being used for limiting the present invention. Any modifications, equivalent replacements, improvements and the like made within the spirit and the principle of the present invention should be fall into the protection scope of the present invention.

What is claimed is:

1. A pair of intelligent massage shoes, each of the intelligent massage shoes comprising a vamp, a sole composed of a sole plate and a cushion plate, and massage columns arranged in the sole plate, stretching out of the cushion plate and matched with the positions of the acupuncture points of a sole, wherein a lifting power device for pushing the massage columns to move up and down is arranged in the sole, the lifting power device comprises: at least one guide pillar longitudinally arranged in the sole plate, a lifting motor arranged at one end of the guide pillar to drive the guide pillar to rotate, cams fixed on the guide pillars respectively and matched with the massage columns in positions, and circular rings rotatably sleeved over the outer circles of the cams, wherein the top of each circular ring is fixedly connected with the corresponding massage column, and the cams on the guide pillars, that are adjacent front and back, are fixed at an inclination angle of 90°;

the lifting motor drives the guide pillar to rotate, and the cams push the massage columns to sequentially move up and down through the circular rings;

wherein an adjusting power device for adjusting the front and back positions of the massage columns is also arranged in the sole, the adjusting power device comprising: a pushing and pulling motor arranged in the sole plate, a bottom plate fixedly connected with the lifting power device, a sliding rail assembly arranged between the bottom surface of the bottom plate and the internal bottom surface of the sole, and a connecting rod member arranged between an output shaft of the pushing and pulling motor and the bottom plate;

the cushion plate is provided with strip openings allowing front and back movements of the massage columns;

the pushing and pulling motor drives the connecting rod member to pull the bottom plate, and the bottom plate drives the whole lifting power device to move back and forth along the sliding rail assembly.

2. The intelligent massage shoes according to claim 1, wherein an air pocket having a shape matched with a shape of each of the intelligent massage shoes is arranged between the vamp and the cushion plate, an electric air charging apparatus configured to charge air into the air pocket is arranged in the sole plate and is connected with the air pocket through an air pipe, and an exhaust valve connected with the electric air charging apparatus is also arranged on the outside surface of the sole plate.

3. The intelligent massage shoes according to claim 2, wherein an electrical assembly connected with the lifting power device, the adjusting power device and the electric air charging apparatus respectively is also arranged in the sole plate, the electrical assembly comprising: a printed circuit board (PCB) assembly arranged in the sole plate, a battery connected with the PCB assembly, and a key and a charging socket arranged on the outside surface of the sole plate and connected with the PCB assembly.

4. The intelligent massage shoes according to claim 3, further comprising:

a remote controller arranged outside the massage shoes, a wireless receiving module arranged in the PCB assembly, a wireless transmitting module matched with the wireless receiving device and is arranged in the remote controller, and a remote control key connected with the wireless transmitting module and arranged on the remote controller.

5. The intelligent massage shoes according to claim 1, wherein a positioning pin is transversely arranged at a position, where the cam is located, on each guide pillar, the cam has two side surfaces, one of the two side surfaces of the cam is provided with a positioning groove matched with the positioning pin, and the other of the two side surfaces of the cam is provided with a retainer ring; a concave ring matched with the retainer ring is arranged on the guide pillar, and the cam is positioned on the guide pillar by the positioning groove and the positioning pin, and the front and back positions of the cam are locked by the retainer ring.

6. The intelligent massage shoes according to claim 5, wherein the lifting motor is driven by a gear set having a driving gear and a plurality of driven gears, an output shaft of the lifting motor is connected with the driving gear, each guide pillar is provided with one of the driven gears, the driven gears of adjacent guide pillars are engaged, the driven gear of one guide pillar is engaged with the driving gear; the lifting motor is fixed on the bottom surface of the bottom plate.

7. The intelligent massage shoes according to claim 6, wherein fixing seats for rotatably fixing two ends of each guide pillar are arranged on the bottom plate, two ends of the guide pillar are sleeved with a bearing respectively, each fixing seat is formed by fixedly connecting an upper part and a lower part and is internally provided with a bearing groove matched with the bearing, and the bearing is mounted in the bearing groove;

a plurality of positioning seats are also arranged on the bottom plate, each circular ring is arranged in one of the positioning seats to be capable of sliding up and down, a cylinder stretching out horizontally is arranged on the upper end and the lower end of one side surface of each circular ring respectively, the outer end of the cylinder is sleeved with a roller, and a position where each positioning seat is arranged is adjacent to the corresponding circular ring; each positioning seat is formed by fixedly connecting an upper part and a lower part, a circular groove matched with each guide pillar is formed in the middle of each positioning seat, a side surface, adjacent to the cylinder, of each positioning seat is provided with an upright sliding chute having a size for allowing the roller to slide up and down therein, the outside surface of the upright sliding chute is provided with an upright notch matched with the diameter of the cylinder, and the roller is arranged in the upright sliding chute.

8. The intelligent massage shoes according to claim 1, wherein the sliding rail assembly comprises: sliding rods fixed below two sides of the bottom plate, and at least two sliding rail seats, the top ends of the at least two sliding rail seats are fixed to the bottom surfaces of two sides of the bottom plate, the bottom end of each sliding rail seat is provided with holes matched with the sliding rods, a wall of each hole is provided with grooves that are recessed inwards at intervals, and the siding rod is sleeved with the bottom end of the sliding rail seat through the holes.

* * * * *